US007438251B2

(12) United States Patent
St. Germain et al.

(10) Patent No.: US 7,438,251 B2
(45) Date of Patent: Oct. 21, 2008

(54) WEB TENSIONING DEVICE WITH PLURAL CONTROL INPUTS

(75) Inventors: Patrick C. St. Germain, Iron River, WI (US); Gerald K. Langreck, Phillips, WI (US); Vernon C. Wickman, Port Wing, WI (US); Ryan J. Carlson, Brule, WI (US)

(73) Assignee: Specialty Systems Advanced Machinery, Inc., Iron River, WI (US)

( * ) Notice: Subject to any disclaimer, the term of this patent is extended or adjusted under 35 U.S.C. 154(b) by 702 days.

(21) Appl. No.: 10/717,019

(22) Filed: Nov. 19, 2003

(65) Prior Publication Data

US 2004/0262361 A1 Dec. 30, 2004

Related U.S. Application Data

(63) Continuation-in-part of application No. 10/465,219, filed on Jun. 19, 2003, now abandoned.

(51) Int. Cl.
*B65H 23/18* (2006.01)

(52) U.S. Cl. ..... 242/417.3; 226/118.3; 242/418.1

(58) Field of Classification Search ..... 242/417.3, 242/418.1; 226/104–107, 118.2, 118.3
See application file for complete search history.

(56) References Cited

U.S. PATENT DOCUMENTS

| | | | | | |
|---|---|---|---|---|---|
| 2,171,741 | A * | 9/1939 | Cohn et al. | ..... | 226/118.2 |
| 2,985,396 | A * | 5/1961 | Johnson | ..... | 242/417.3 |
| 3,053,427 | A * | 9/1962 | Wasserman | ..... | 226/118.2 |
| 3,463,413 | A * | 8/1969 | Smith | ..... | 242/417.3 |
| 4,549,701 | A * | 10/1985 | Lucas | ..... | 242/417.3 |
| 5,659,229 | A * | 8/1997 | Rajala | ..... | 318/6 |
| 5,964,390 | A * | 10/1999 | Borresen et al. | ..... | 226/118.2 |
| 6,024,319 | A * | 2/2000 | Kawabata et al. | ..... | 242/417.3 |
| 6,067,778 | A * | 5/2000 | Yamamoto et al. | ..... | 242/417.3 |
| 6,547,707 | B2 * | 4/2003 | Cote | ..... | 242/417.3 |

* cited by examiner

*Primary Examiner*—Peter M. Cuomo
*Assistant Examiner*—Scott Haugland
(74) *Attorney, Agent, or Firm*—Olson & Cepuritis, Ltd.

(57) ABSTRACT

A web tensioning device utilizes a dancer arm which can be positioned by a controlled servo motor. In a preferred embodiment, the controller for the servo motor receives an input signal based on the acceleration (positive or negative) of the dancer arm and implements a torque component necessary to maintain predetermined web tension, for example, an applied torque component that changes the position of the dancer arm. The controller may also receive additional input signals indicative of the acceleration of the web itself.

5 Claims, 2 Drawing Sheets

WEB TENSIONING DEVICE WITH PLURAL CONTROL INPUTS

CROSS-REFERENCE TO RELATED APPLICATION

This application is a continuation-in-part of U.S. patent application Ser. No. 10/465,219 filed on Jun. 19, 2003 now abandoned.

FIELD OF INVENTION

This invention relates to devices for tensioning webs, such as paper webs or textile webs, during processing.

BACKGROUND OF THE INVENTION

Web tension control is important in paper conversion processes and the like. In high speed operations, even relatively small variations in web tension may cause web processing difficulties downstream. Moreover, in relatively high speed web lines, such as those exceeding about 500 feet per minute (about 150 meters per minute), manual adjustment of web tension is not practical.

In web tensioning systems where web tension is controlled or maintained by a dancer, a limitation on effective control of web tension is the response time of the dancer inasmuch as often the dancer movement lags behind the actual changes in web tension. A primary cause of such relatively long response time is the weight of the dancer. Thus, it would be desirable to have a web tensioning device that responds readily to variations in web tension with minimum lag time. The present invention satisfies this need.

SUMMARY OF THE INVENTION

A web tensioning device of the present invention provides an improved dancer arm and a controller therefor that responds readily to variations in web tension during web processing with minimal delay, and maintains web tension within predetermined limits without reliance on gravitational forces.

The present web tensioning device includes a base, a dancer arm with at least one dancer and movably mounted to the base, and a servo motor that positions the dancer arm in response to a control output signal which depends on web tension requirement at a given point in time. The control output signal to the servo motor is provided by a controller that is operably associated with the servo motor and is responsive to a web tension requirement communicated to the controller either by movement of the dancer arm or a web feed rate actuator. The dancer arm can be provided with plural dancers, e.g., two or four dancers, if desired. Moreover, a particular web conversion machine can utilize more than one dancer arm.

The dancer can be a dancer roller, a fixed shaft, an air bearing fixed shaft, and the like. The dancer assembly can be pivoting as well as a straight running accumulator, as desired.

In one particular embodiment, the present web tensioning device includes a dancer arm suitable for engaging the web to be tensioned. The dancer arm has a free end portion that carries a dancer roller mounted thereon and a fixed end portion that is pivotably mounted to a base and so as to coact with an angular position sensor that indicates the relative angular displacement of the dancer arm while tension is maintained in the web. The web can be a paper web fed to a paper converting machine, a fabric web, and the like.

A servo motor is operably associated with the dancer arm for pivotally positioning the dancer arm in engagement with the web by application of a torque in response to a control signal from a controller. Input to the controller can be provided by the angular position sensor, a position feedback device such as an encoder, and the like, that monitors the angular displacement of the dancer arm from a predetermined position as the web is fed from an unwind roll to further processing station or stations.

Figure 1:
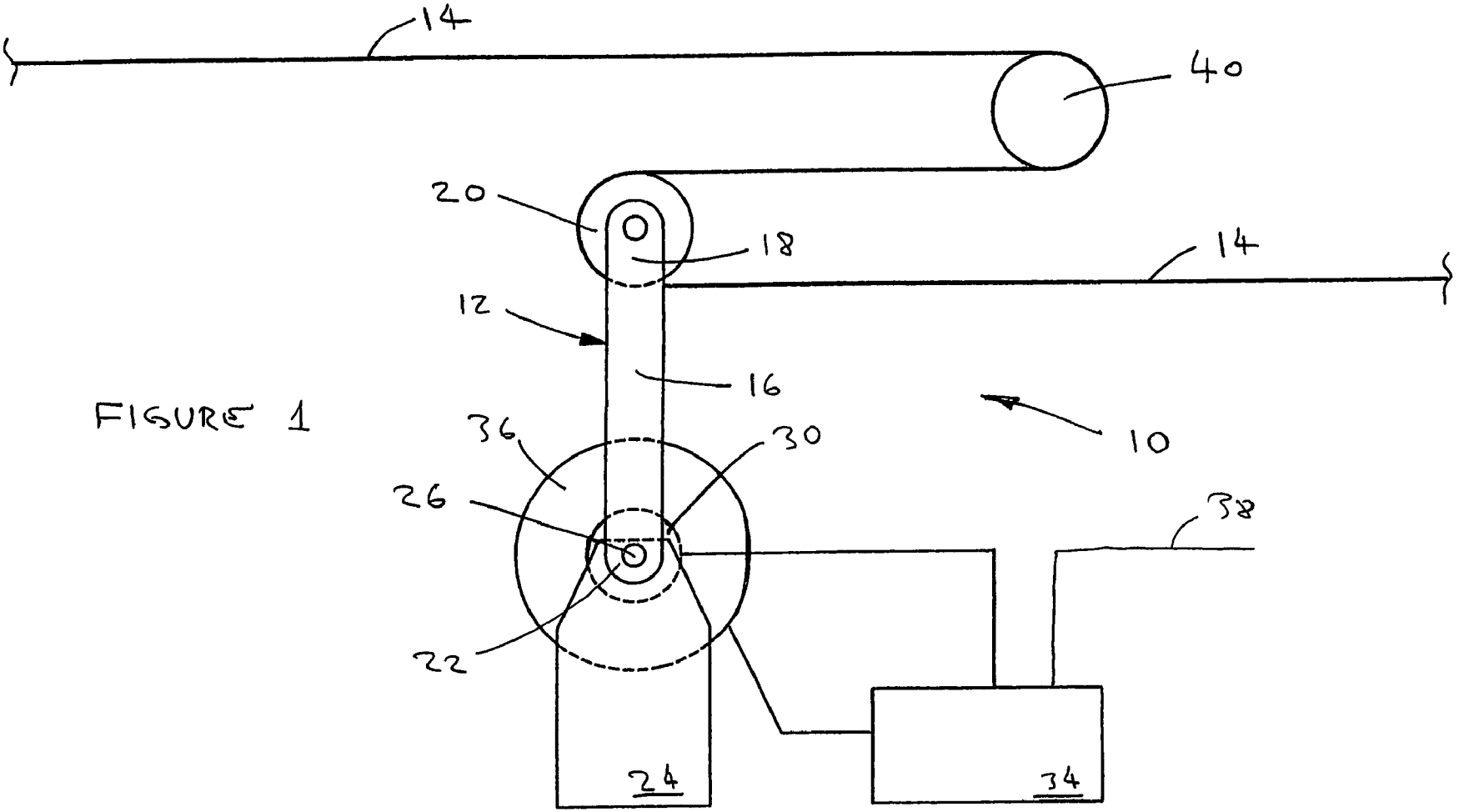
FIG. 1 is a schematic depiction of the web tensioning device embodying the present invention and utilizing a position feedback mode of operation.

In the FIGURES, legends having the same last two digits denote elements that perform the same or similar function.

DESCRIPTION OF THE PREFERRED EMBODIMENTS

An industrial web converting machine usually performs its processing function utilizing a continuous sheet or web of paper or other non-woven material (e.g., yarn, wire, tubing, or filament), fabric, foil, and the like. The web is pulled by one or more power driven rollers through a series of idler (or non-driven) rollers to one or more processing stations or stages where the web is folded, cut into segments, shaped, etc. The web is fed into the machine from a relatively large roll called an "unwind roll" which rotates on a roll stand.

The web often travels at different speeds through different sections of the converting machine and becomes slack from time to time, either by design or otherwise. A web that is slack can become undesirably tangled or wrinkled. To control slack, a web processing system frequently utilizes a dancer which typically is one or more idler rollers or shafts on non-rotating arms that move freely against the web, usually by being mounted on a pivoting arm of some sort. The dancer controls web tension by increasing or decreasing at any point in time the accumulation (festoon) of the web at a given location. Under balanced conditions the dancer remains stationary, i.e., in a neutral position, but is positioned as needed depending on whether web tension is to be increased or decreased as a result of the operation of the web converting machine or the like.

In a typical application, a dancer is mounted to a pivotably mounted arm to which a positioning force is applied by a spring, a solenoid, a pneumatic cylinder, a hydraulic cylinder, and the like force generator. The positioning force urges the dancer tightly against the web.

Often a condition is encountered, e.g., with an out-of-round unwind roll or variable tension produced by an unwind mechanism, that causes cyclical web acceleration followed by web deceleration at a relatively high frequency. As a result, the dancer rapidly moves back and forth due to a force supplied by the web to move the mass of the dancer as the web tension cycles between tight and loose. Such rapidly alternating web tension necessarily leads to operating problems downstream, and thus a need for a controlled loop or festoon to provide time for correcting web condition on the converter.

The present invention obviates such problems by simulating a "zero mass" dancer vis-a-vis the web in contact therewith. To that end, a servo motor is utilized in lieu of the conventional force generators that have been used to pivot the dancer arm and tension the web. Any action by the web that causes the dancer arm to shift position is monitored by a position sensor, typically an encoder. Other types of position sensors can be utilized as well for this purpose, however. An output signal from the position sensor is transmitted as input to a controller that signals the servo motor to correct the web tension so as to return the dancer arm to its predetermined "neutral" position.

The term "servo motor," as used herein and in the appended claims, means an electric, hydraulic or other type of motor, including a limited angle motor, linear motor, embedded motor, and the like, that serves as the final control element of an automatic feedback control system for mechanical motion. A preferred motor is a torque feedback electric motor.

Referring to FIG. 1, a web tensioning system 10 is shown utilizing web tensioning device 12 engaging a tensioned segment of web 14 which is also wrapped around idler roll 40. Web tensioning device 12 includes dancer arm 16 that carries at the free end 18 thereof a dancer, such as rotatably mounted dancer roll 20 that also serves as a web redirect roller. Fixed end 22 of dancer arm 16 is pivotably mounted to base 24 by shaft 26 which is affixed to dancer arm 16 and in turn is journaled in base 24.

Also fixedly mounted to shaft 26 is an encoder, such as incremental rotary optical encoder 30, which serves as an angular position sensor and indicates the relative angular position of pivot shaft 26, and thus dancer arm 16. Information from the rotary optical encoder 30 provides an appropriate input signal to dancer control 34. The encoder can be an incremental encoder or an absolute encoder, as desired.

Operably mounted to pivot shaft 26 is a limited angle electric servo motor 36 which turns pivot shaft 26, and thus positions dancer arm 16 by pivoting it in response to a control output signal from dancer arm controller 34. In this manner, initial tension on the web 14 can be set to a predetermined value and thereafter maintained. A relatively small rotation of pivot shaft as a result of change in web tension provides information via encoder 30 as input signal to controller 34. This input signal is processed rapidly by dancer control 34, and a control output signal is sent to energize servo motor 36. The control output signal determines what torque output and the direction thereof (i.e., clockwise or counterclockwise) is to be provided by servo motor 36 to maintain the desired tension. The amount of torque to be provided is substantially the same as the dancer acceleration or deceleration force, i.e., positive or negative acceleration force, whatever the case may be. The response time of the servo motor 36 to the control output signal provided by dancer control 34 is relatively short, usually of the order of about 0.0005 seconds or less. Thus the torque supplied by servo motor 36 balances out the dancer movement forces as they occur, and web tension remains substantially constant so that the dancer has substantially no inertia to overcome. With respect to the web dynamics, the dancer appears to have "zero mass."

The aforedescribed operation of web tensioning system 10 is the so-called feedback control method. A compensating torque command component is supplied to servo motor 36 in proportion to measured acceleration or deceleration of the dancer. In any given application, accuracy of the feedback control method is determined by the inertia of the moving parts of the web tensioning device, accuracy of the acceleration and deceleration measurement, and the information processing rate of the controller.

Alternatively, a control method can be utilized for web tensioning that also includes a control input signal based on web feed rate or web acceleration at any desired stage of web processing downstream or upstream of the dancer arm. Additional control input to dancer control 34 can be provided via line 38, for example, by a web feed rate actuator in an additional control loop that includes servo motor 36 and dancer control 34. Dancer control 34 then serves as combined feedback and feedforward controller to provide a total web tensioning control effort. That is, a compensating torque command component can be applied in proportion to web acceleration or deceleration information obtained from the web feed rate actuator or the like. For this purpose feedback as well as feedforward control strategies can be utilized to sense deviations from a set point and to compensate therefor before a controlled variable such as web tension materially deviates from the set point.

Figure 2:
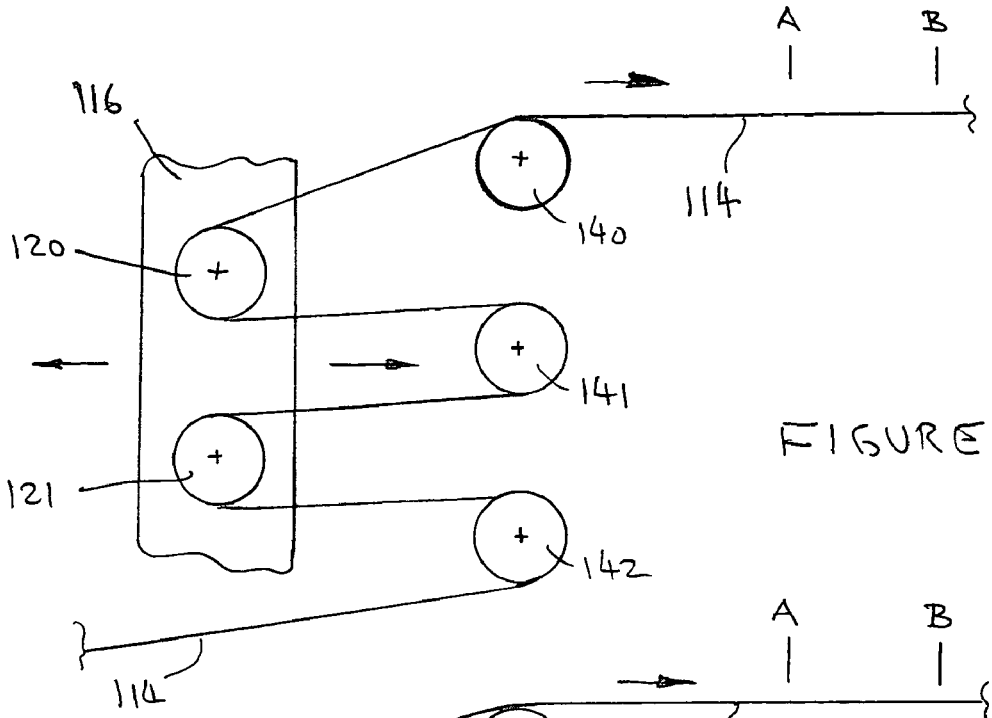
FIG. 2 is a schematic depiction of web tensioning dancer arrangement that utilizes a pair of dancers mounted to a dancer arm.

Inertia effects on the web that is being processed can be further minimized, if desired, by the use of plural dancers carried on the same dancer arm. FIG. 2 illustrates an embodiment having a pair, i.e., two, dancers 120 and 121 rotatably mounted to straight running dancer arm 116 and engaging web 114 with the assistance of idler rollers 140, 141 and 142.

Figure 3:
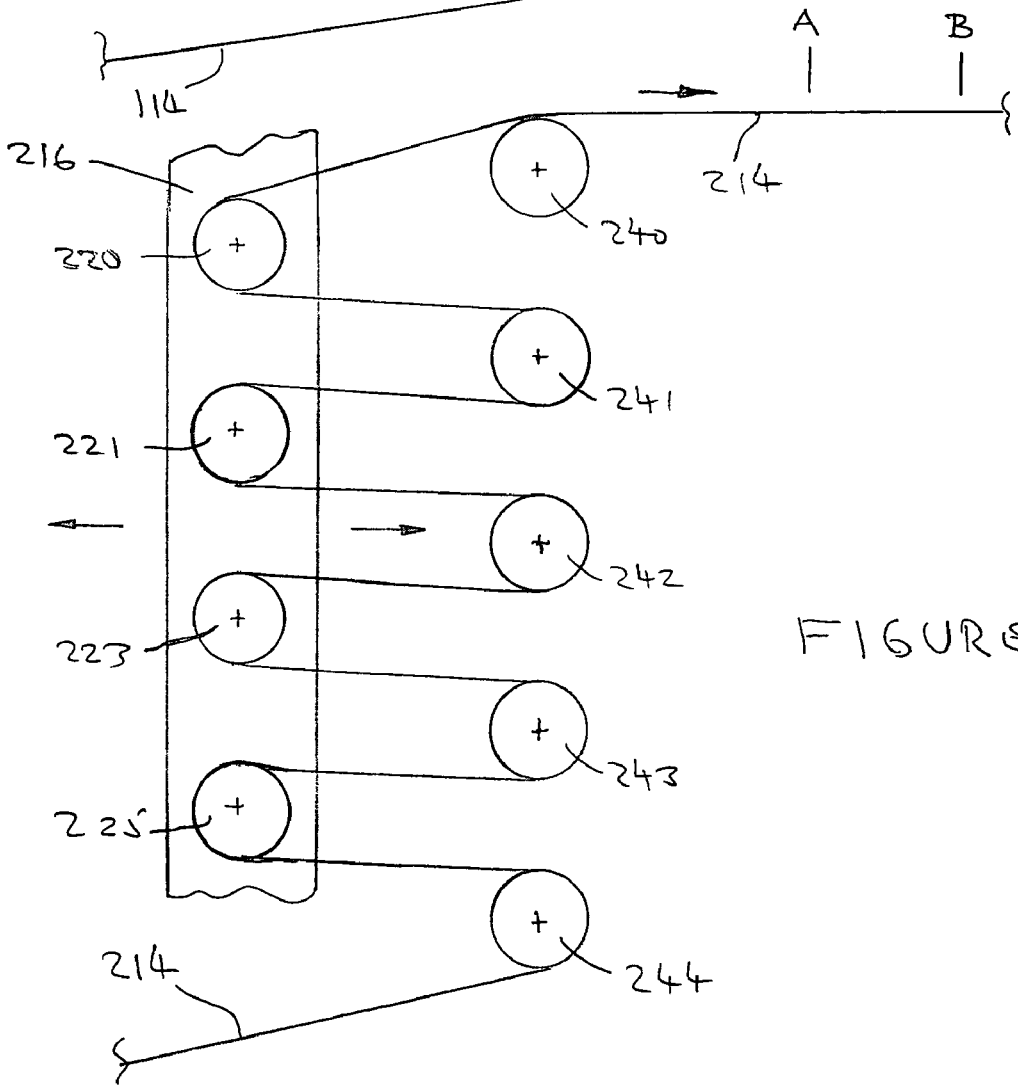
FIG. 3 is a schematic depiction of web tensioning dancer arrangement that utilizes four dancers mounted to a dancer arm.

Similarly, FIG. 3 illustrates yet another embodiment having an array of four dancers 220, 221, 223 and 225 rotatably mounted to dancer arm 216 and engaging web 214 with the assistance of idler rollers 240, 241, 242, 243 and 244.

The differences in web tension that are achievable by varying the number of dancers on the same dancer arm are illustrated by the calculations below.

Assuming a web acceleration from Point A to Point B of 1 meter/second$^2$ (m/s$^2$) and a dancer mass of 1 kilogram (kg), the theoretical acceleration (i.e., neglecting friction and rotational inertia) of the single dancer shown in FIG. 1 is 1 m/s$^2$÷2 or 0.5 m/s$^2$. Thus the force on the web generated by dancer acceleration, force=(mass)(acceleration), is 1 kg×0.5 m/s$^2$ or 0.5 Newtons (N), and the tension on the web is 0.5 N÷2 or 0.25 N.

Applying the same assumptions to the dancer system shown in FIG. 2, the theoretical acceleration of each dancer is 1 m/s$^2$÷4 or 0.25 m/S$^2$ and the total force on the web generated by dancer acceleration is 2 kg×0.25 m/s$^2$ or 0.5 N. However, the tension on the web in this case is distributed over four web portions and is calculated to be 0.5 N÷4 or 0.125N.

When the same assumptions are applied to the four dancer-system shown in FIG. 3, the theoretical acceleration of each dancer is even less, i.e., 1 m/s$^2$÷8 or 0.125 m/s$^2$. The total force generated by dancer acceleration is 4 kg×0.125 m/s$^2$ or 0.5 N, but the tension on the web is distributed over eight web portions and is reduced to 0.5 N÷8 or 0.0625 N.

The foregoing description and the drawing are illustrative, and are not to be taken as limiting. Still other variations and arrangements of parts within the spirit and scope of the present invention are possible and will readily present themselves to those skilled in the art.

We claim:

1. A web tensioning device which comprises:

a base;

an angular position sensor;

a dancer arm for engaging the web to be tensioned, having a free end portion with a dancer rotatably mounted thereon and a fixed end portion pivotably mounted to the base so as to coact with the angular position sensor and indicate relative angular displacement of the dancer arm as a web in contact with the dancer is maintained in tension;

a servo motor operably associated with the dancer arm for pivotally positioning the dancer arm by application of a compensating torque component in response to a control output signal; and a controller for generating the control output signal in response to acceleration of the dancer arm due to changes in web tension as detected by the angular position sensor;

the applied compensating torque component being substantially the same as force of the dancer arm acceleration.

2. The web tensioning device in accordance with claim 1 wherein the angular position sensor is an encoder operably associated with the fixed end portion of the dancer arm and senses relative angular displacement of the dancer arm.

3. The web tensioning device in accordance with claim 2 wherein the encoder is an incremental rotary optical encoder.

4. The web tensioning device in accordance with claim 1 wherein the servo motor is an electric motor.

5. The web tensioning device in accordance with claim 4 wherein the servo motor is a limited angle electric motor operably associated with the dancer arm for pivoting the dancer arm by application of torque in response to the control output signal.

* * * * *